US009931837B2

(12) United States Patent
Anderson et al.

(10) Patent No.: US 9,931,837 B2
(45) Date of Patent: Apr. 3, 2018

(54) MODULES TO IDENTIFY NOZZLE CHAMBER OPERATION

(71) Applicant: HEWLETT-PACKARD DEVELOPMENT COMPANY, L.P., Houston, TX (US)

(72) Inventors: Daryl E Anderson, Corvallis, OR (US); Eric T Martin, Corvallis, OR (US); Peter James Fricke, Corvallis, OR (US); James Michael Gardner, Corvallis, OR (US)

(73) Assignee: Hewlett-Packard Development, L.P., Houston, TX (US)

( * ) Notice: Subject to any disclaimer, the term of this patent is extended or adjusted under 35 U.S.C. 154(b) by 0 days.

(21) Appl. No.: 15/307,865

(22) PCT Filed: Jun. 30, 2014

(86) PCT No.: PCT/US2014/044826
§ 371 (c)(1),
(2) Date: Oct. 31, 2016

(87) PCT Pub. No.: WO2016/003403
PCT Pub. Date: Jan. 7, 2016

(65) Prior Publication Data

US 2017/0106646 A1 Apr. 20, 2017

(51) Int. Cl.
*B41J 2/14* (2006.01)
*B41J 2/045* (2006.01)
*B41J 2/165* (2006.01)

(52) U.S. Cl.
CPC ..... *B41J 2/0451* (2013.01); *B41J 2/0458* (2013.01); *B41J 2/04541* (2013.01); *B41J 2/14153* (2013.01); *B41J 2/16579* (2013.01)

(58) Field of Classification Search
CPC .. B41J 2/0451; B41J 2/041541; B41J 2/0458; B41J 2/14153; B41J 2/16579
(Continued)

(56) References Cited

U.S. PATENT DOCUMENTS 6,575,548 B1 6/2003 Corrigan, III et al.
6,729,707 B2 5/2004 Corrigan
(Continued)

FOREIGN PATENT DOCUMENTS

EP 0139538 5/1985
EP 0464733 1/1992
(Continued)

OTHER PUBLICATIONS

Xavier Bruch et al., "Extending Life of Thermal Inkjet Printheads for Commercial Applications," IS&T's NIP18: 2002 International Conference on Digital Printing Technologies, Jan. 1, 2002, pp. 103-107.
(Continued)

*Primary Examiner* — Huan Tran
*Assistant Examiner* — Alexander D Shenderov
(74) *Attorney, Agent, or Firm* — HP Inc. Patent Department

(57) ABSTRACT

An example device in accordance with an aspect of the present disclosure includes modules to communicate an input signal to an ink sample to obtain an ink signal, compare the ink signal to a reference value, and identify an indicator of nozzle chamber operation corresponding to the ink signal. A module may be contained on an inkjet printhead die, such that the device may generate the input signal on the inkjet printhead die.

20 Claims, 5 Drawing Sheets

(58) Field of Classification Search
USPC ..... 347/7, 81
See application file for complete search history.

(56) References Cited

U.S. PATENT DOCUMENTS

| | | | | |
|---|---|---|---|---|
| 7,717,531 | B2 | 5/2010 | Paasch | |
| 8,336,981 | B2 | 12/2012 | Chen et al. | |
| 8,870,322 | B2 | 10/2014 | Ratan | |
| 9,044,936 | B2 | 6/2015 | Van Brocklin | |
| 2002/0021315 | A1 | 2/2002 | Sato et al. | |
| 2012/0081471 | A1* | 4/2012 | Liao | B41J 2/04521 347/57 |
| 2013/0187974 | A1 | 7/2013 | Govyadinov et al. | |
| 2013/0278656 | A1* | 10/2013 | Govyadinov | B41J 2/2142 347/9 |

FOREIGN PATENT DOCUMENTS

| | | |
|---|---|---|
| EP | 3154789 | 4/2017 |
| WO | WO-2010047704 | 4/2010 |
| WO | WO-2015101060 | 12/2015 |

OTHER PUBLICATIONS

The International Bureau of WIPO, International Preliminary Report on Patentability for PCT/US2014/044826 dated Jan. 12, 2017 (11 pages).

* cited by examiner

MODULES TO IDENTIFY NOZZLE CHAMBER OPERATION

BACKGROUND

A nozzle of an inkjet printhead fires to eject an ink drop. The firing of the nozzle may be based on formation of a drive bubble in a firing chamber. After the nozzle fires, the bubble collapses and the ink chamber may refill with ink. The refill and/or ink drop qualities may be affected over time (volume, velocity, blocked ejection path) by nozzle health, e.g., clogging, presence of particles, trapped bubbles in firing chamber, and so on.

BRIEF DESCRIPTION OF THE DRAWINGS/FIGURES

DETAILED DESCRIPTION

Examples provided herein enable measurement of nozzle health on a printhead (e.g., of an inkjet printer or other system that ejects a fluid). An example device may apply electrical stimulus (e.g., an input signal) to ink of a given nozzle, and process the resulting electrical voltage/impedance waveform (e.g., ink signal) that results from application of the input signal. A device may evaluate when ink refill has occurred after a firing event, e.g., based on modules and/or circuitry such as a comparator for comparing the ink signal waveform against a threshold, and a counter for processing output of the comparator. Thus, example devices enable drive bubble detection (DBD), to determine whether a printhead nozzle is healthy, by observing a status of the nozzle over time.

Example devices enable evaluation of the health of a nozzle to be accomplished on the printhead die, to minimize the potential for timing issues or communication bandwidth issues that may arise with off-die approaches that send and/or receive communications off-die. For example, signals may be communicated off-die, but this may introduce issues such as electrical noise, and a need to adding communication lines (e.g., between the printhead and a printer/controller). The signal(s) may need high-impedance line(s), posing a challenge for coupling off-die in view of increased effects of noise. Further, the amount of silicon space available for modules/circuitry to accomplish the evaluation on a printhead die can be limited and costly, which may prevent the complex circuitry of other approaches of signal generation and/or analysis from even fitting on an inkjet printhead die. In contrast, examples provided herein are based on modules/circuitry that enable signal generation and/or analysis to be accomplished on-die. Ink drop qualities of the inkjet printheads may be determined, based on detection of various nozzle defects (deprimed nozzle chambers, clogged nozzles, internal particles, etc.). A device may use modules that are based on a minimal amount of circuitry, which can reasonably be contained on an inkjet printhead. Thus, an indication of nozzle chamber function/operation may be achieved (encompassing qualities of the ink, the chamber heater for generating drive bubbles, the nozzle, etc.), based on, e.g., whether or not ink was successfully fired.

Figure 1:
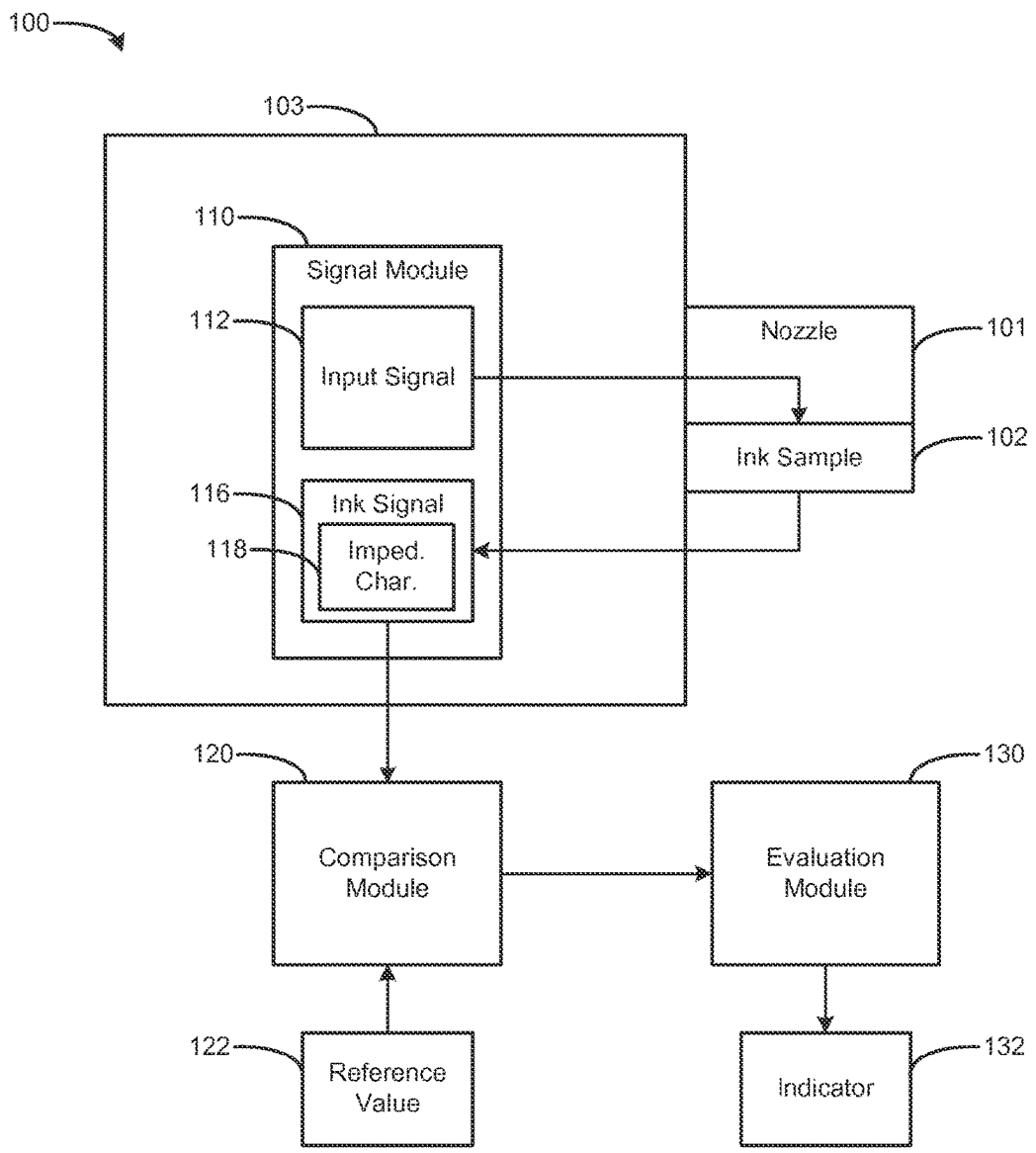
FIG. 1 is a block diagram of a device including a signal module according to an example.
Figure 2:
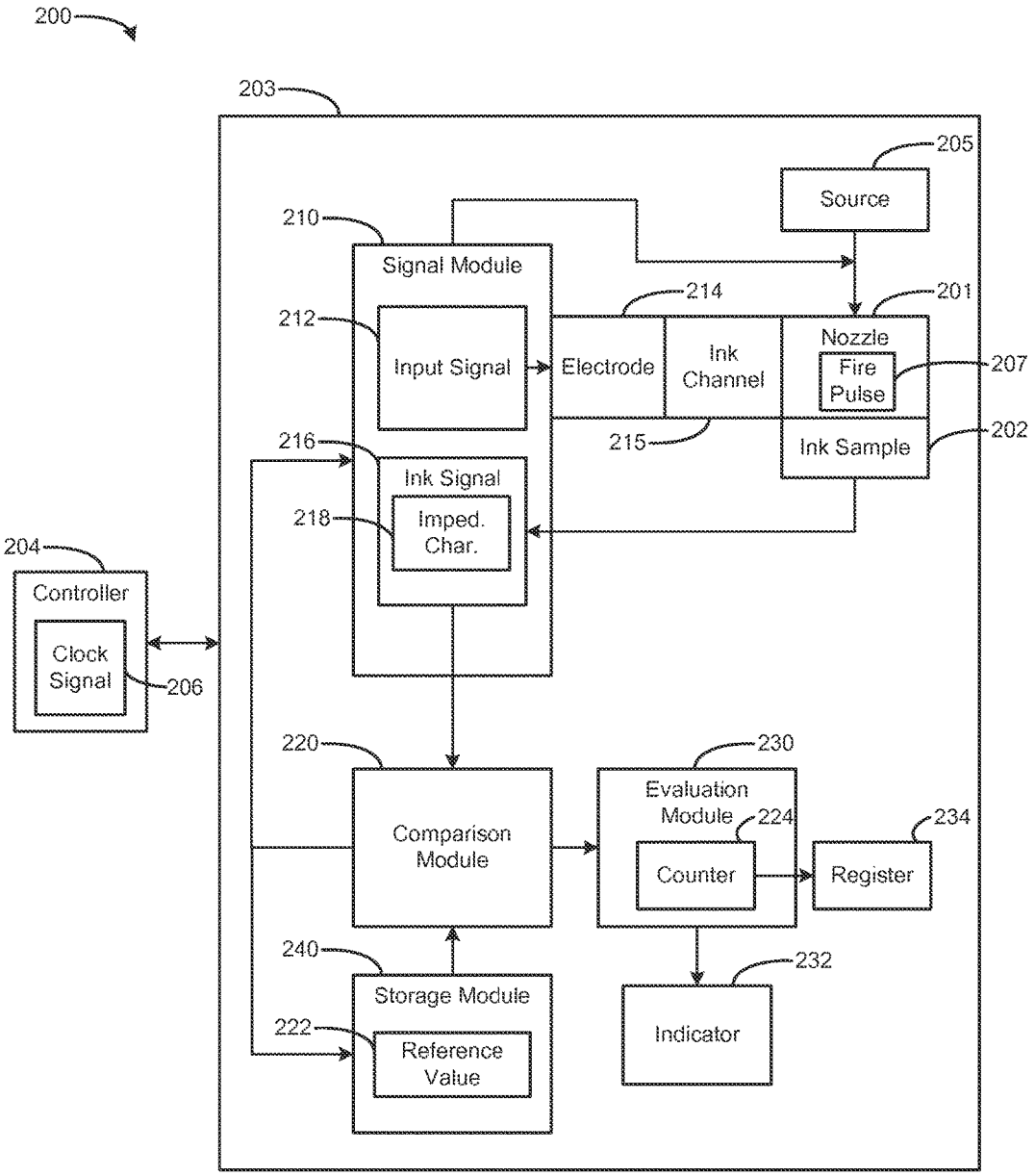
FIG. 2 is a block diagram of a device including a signal module according to an example.

FIG. 1 is a block diagram of a device 100 including a signal module 110 according to an example. The device 100 is coupled to a nozzle 101 and ink sample 102, and also includes a comparison module 120 and evaluation module 130. The signal module 110 is to provide input signal 112 and receive ink signal 116. The ink signal 116 is associated with an impedance characteristic 118. The ink signal 116 is communicated to the comparison module 120, which is associated with a reference value 122. Results of the comparison module 120 are evaluated by the evaluation module 130. The evaluation module 130 is to provide an indicator 132, e.g., an indication of nozzle chamber health. FIG. 1 shows the comparison module 120 and the evaluation module 130 as being separate from the die 103. In alternate examples, a module may be on-die or off-die (e.g., see FIG. 2 showing additional modules on-die). Furthermore, modules may be combined and/or omitted, e.g., combining and/or moving functionality from one module to another module.

A nozzle 101 may couple signals to and/or from the ink sample 102, to monitor a status of the ink sample 102 (e.g., monitor for the presence or absence of a bubble). The nozzle 101 (which may include other components of a nozzle chamber, such as a heater, a sensor, and so on) may be associated with a sensor or other mechanism to conduct the input signal 112 to the ink sample 102, and obtain the ink signal 116. For example, a capacitive sensor may be provided at the firing chamber represented by the nozzle 101. In an alternate example, the nozzle 101 itself may operate as a sensor. Timing and/or profiling of drive bubble formation and collapse at the nozzle 101 enables assessment of nozzle health (which may include ink deprime, as indicated by the presence of a static air bubble in the nozzle chamber). Thus, the ink signal 116 as used herein may represent more than an indication of an inherent quality of the ink itself. Rather, the ink signal 116 may indicate an impedance across the sensor, nozzle chamber, and/or nozzle, as it would be affected by an amount of ink and/or the conditions and quantity (or absence thereof) of the ink sample 102 at the sensor, nozzle chamber, and/or nozzle.

Drive bubble detection (DBD) may use the sensor associated with the nozzle/nozzle chamber, and the sensor (e.g., an electrode) may be integral to the nozzle 101. Firing a nozzle may use a heater to generate a steam/vapor bubble that ejects ink out of the nozzle. The sensor may be located in the chamber. The measurement may be taken with an impedance sensor that is capable of measuring resistance, impedance, or combinations thereof. The sensor may be placed within a region of the ink chamber where the ink bubble is expected to form. Impedance at the nozzle/sensor changes according to formation and subsequent collapse of the bubble. There are a range of defects with a nozzle that can affect the bubble formation and/or the ink drop from firing out of the nozzle. Such defects can modify the timing and other qualities of the formation of the bubble, and/or the subsequent collapse of the bubble. Examples herein enable an indication of nozzle chamber function/operation. For example, the printhead die 103 may apply electrical stimulus (input signal 112) to the ink sample 102 of a given nozzle 101, and examine the resulting electrical voltage/impedance waveform of the ink signal 116. The device 100 may make a measurement of some component of impedance, such as the resistive (real) components at a frequency range determined by the type of voltage source supplying the voltage or current to the sensor. Such information about the ink signal 116 enables the device 100 to evaluate, e.g., when ink refill has occurred after a nozzle firing event, using minimal circuitry/modules. The signal generation and/or analysis may be carried out within the printhead die 100, without a need for signals to be communicated off-die (e.g., to the printer or other controller) for interpretation. Accordingly, such on-die signals are less exposed to being corrupted, intercepted, or spoofed (e.g., for counterfeit ink).

The device 100 may evaluate the ink signal 116 based on the reference value 122. For example, the signal module 110 may provide an input signal 112 to the ink sample 102, and obtain the ink signal 116 associated with an impedance characteristic 118. The comparison module 120 may compare the impedance characteristic 118 to the reference value 122. The reference value may be set/initialized and stored at the device 100, e.g., by an external controller or printer (not shown in FIG. 1) that loads a storage (not shown in FIG. 1) associated with the comparison module 120. In an alternate example, the reference value 122 may be set during manufacture of the device 100, e.g., based on empirical analysis of ink and nozzle health behavior/characteristics. Accordingly, the evaluation module 130 can provide an indicator 132 of nozzle chamber health based on whether the ink signal 116 is consistent with the reference value 122.

The device 100 also may operate iteratively (e.g., sweep through a range of values) to evaluate the ink signal 116 and provide the indicator 132 of nozzle chamber health. For example, the signal module 110 may generate an initial input signal 112, and comparison module 120 may compare it with an initial reference value 122. The signal module 110 may iteratively adjust the input signal 112, and/or the comparison module 120 may iteratively adjust the reference value 122, until the ink signal 116 is consistent with the reference value 122, at which point the evaluation module 130 may provide the indicator 132.

FIG. 2 is a block diagram of a device 200 including a signal module 210 according to an example. The device 200 is coupled to a nozzle 201, ink sample 202, electrode 214, and ink channel 215. The nozzle 201 may be activated based on a fire pulse 207. The device 200 also includes a comparison module 220, evaluation module 230, and storage module 240. The signal module 210 is to provide input signal 212 and receive ink signal 216. The ink signal 216 is associated with an impedance characteristic 218. The signal module 210 is also to control the source 205 (e.g., current source, voltage source, etc.), during firing of the nozzle 201 based on the fire pulse 207, and/or for choosing which nozzle 201 is to be coupled to the source 205. The signal module 210 also may receive control signals from comparison module 220 and/or controller 204 (e.g., for iterative operation). The controller 204 may provide a clock signal 206. The ink signal 216 is communicated to the comparison module 220. The comparison module 220 is coupled to the storage module 240 to receive the reference value 222. Results of the comparison module 220 are passed to the evaluation module 230. The evaluation module 230 is to provide an indicator 232, and includes a counter 224. The counter 224 may store a counter value in the register 234. FIG. 2 shows the comparison module 220 and the evaluation module 230 as being on-die with the other modules. In alternate examples, a module may be on-die or off-die.

The nozzle 201 is shown associated with an ink channel 215 and electrode 214. The electrode 214 is fluidically coupled to an ink channel 215 and/or the ink sample 202 associated with the nozzle 201. Impedance, and/or other characteristics of the ink sample 202, may be sensed by the electrode 214. The electrode 214 may be provided as a plate made of a material of a predetermined resistance, such as a metal. For example, the electrode 214 may be made of tantalum, copper, nickel, titanium, other such metals, or combinations thereof. The ink sample 202 may be grounded by a ground element (not shown), which may also be located anywhere within an ink nozzle chamber or ink reservoir. In an example, the ground element may be provided as an etched portion of a wall with a grounded, electrically conductive material exposed. When, in the presence of ink sample 202, a voltage is applied to the electrode 214, an electrical current may pass from the electrode 214 through the ink sample 202 to the ground element, thereby generating the ink signal 216 and associated impedance characteristic 218.

In operation, the signal module 210 may couple the source 205 to a given nozzle 201, to be active during the fire pulse 207. The signal module 210 also may provide input signal 212 to the electrode 214 associated with the nozzle 201, to monitor the response of the ink sample 202 to the input signal 212, in the form of the ink signal 216 and associated impedance characteristic 218. The comparison module 220 may compare the ink signal 216 to the reference value 222 of the storage module 240. The comparison results are passed to the evaluation module 230. For example, the comparison module 220 may check whether the ink signal 216 is greater than or equal to the reference value 222. Upon meeting that criteria, the evaluation module 230 may begin counting 224. In an example, the counter 224 is incremented according to the clock signal 206 (or division thereof) from the controller 204. The counter 224 may be stopped when the evaluation criteria is no longer met (e.g., the ink signal 216 is less than the reference value 222). Based on the results of the counter 224, the evaluation module 230 may provide an indicator 232 of the health of the ink nozzle chamber, and may store the results of the counter 224 at the register 234 for future reference (e.g., the next iteration).

The controller 204 may interact with the device 200. For example, to load the reference value 222 into the storage module 240, to specify an input signal 212 to the signal module 210, to read a count stored in the register 234, or perform other readings/adjustments. The controller 204 may be a controller such as a central processing unit (CPU) of a computer, a processor of a printer, and/or a controller, processor, and/or application-specific integrated circuit (ASIC) (e.g., provided on the printhead). In an example, a printer may provide initialization values to the device 200 at a printer startup. In an alternate example, a printhead may contain electronically programmable read-only memory (EPROM) at the printhead to store a value(s), which may be loaded into the various modules/components of the device 200. Such values may be stored at the printhead at a time of manufacture, and/or may be later provided and/or updated at a time of boot-up and/or runtime. The controller 204 may provide the clock signal 206. In an example, the printhead is operable based on a main clock signal 206, and may provide sub-divisions of the clock signal 206 to create timing increments of variable resolution.

The device 200 may be operated iteratively by shifting the reference value 222, which may be used by the comparison module 220 as a threshold voltage against which the ink signal 216 is compared. The reference value 222 thus may be used to determine when the ink signal 216 meets or exceeds the threshold, according to a comparison. The device 200 may perform multiple (e.g., iterative) such comparisons/measurements, based on multiple fire pulses 207 and corresponding firings of the nozzle 201. In an iteration where the nozzle 201 is to be fired, the threshold reference value 222 may be set at a different (e.g., updated) level. For example, the reference value 222 may be set low, the nozzle 201 may be fired, and the comparison module 220 may check whether the ink signal 216 meets or exceeds the reference value 222. If not, the reference value 222 may be incremented (or, in an alternate example, decremented), and another iteration may be performed. Iterations may be repeated until the comparison module 220 identifies that the ink signal 216 meets or exceeds the reference value 222, at which point a value for the ink signal 216 has been characterized (e.g., a value corresponding to the reference value 222). The counter 224 also may be used. Thus, the ink signal 216 may be characterized based on a reference value 222 and timing of the counter 224, which can characterize the shape/slope of the ink signal 216 over time according to iteratively comparing with a threshold reference value 222. Such characterization may be used to assess the health of the nozzle chamber by providing indicator 232, such as an indication of whether the nozzle is partially blocked and so on.

Counting by the counter 224 may be started, e.g., in accordance with the fire pulse 207. For example, the counter 224 may be started at the beginning (a leading edge) of the fire pulse 207, during the fire pulse 207 (between a leading edge and trailing edge), or at the end of the fire pulse 207 (a trailing edge). The counter 224 then may begin counting time units, which may be defined in terms of the clock signal 206 or sub-division thereof. The time units may be counted until the reference value 222 threshold is crossed by the ink signal 216, as determined by the comparison module 220 comparing the ink signal 216 to the reference value 222. The comparison module 220 may perform this comparison whether the reference value 222 is held at a fixed threshold or adjusted/incremented iteratively. Upon identifying that the ink signal 216 is consistent with the reference value 222, the comparison module 220 may signal to the evaluation module 230 that the counter 224 is to stop incrementing. The evaluation module 230 may consider the value of the counter 224 directly to set the indicator 232, and/or may register the value of the counter 224 into a memory (such as register 234 as shown, or other type of memory). The register 234 may hold the count for posterity, e.g., while the counter 224 is taking another measurement (e.g., a second iteration). The value of the count also may be examined by the controller 204, to determine whether the count is indicative of an unhealthy print nozzle chamber.

Figure 3:
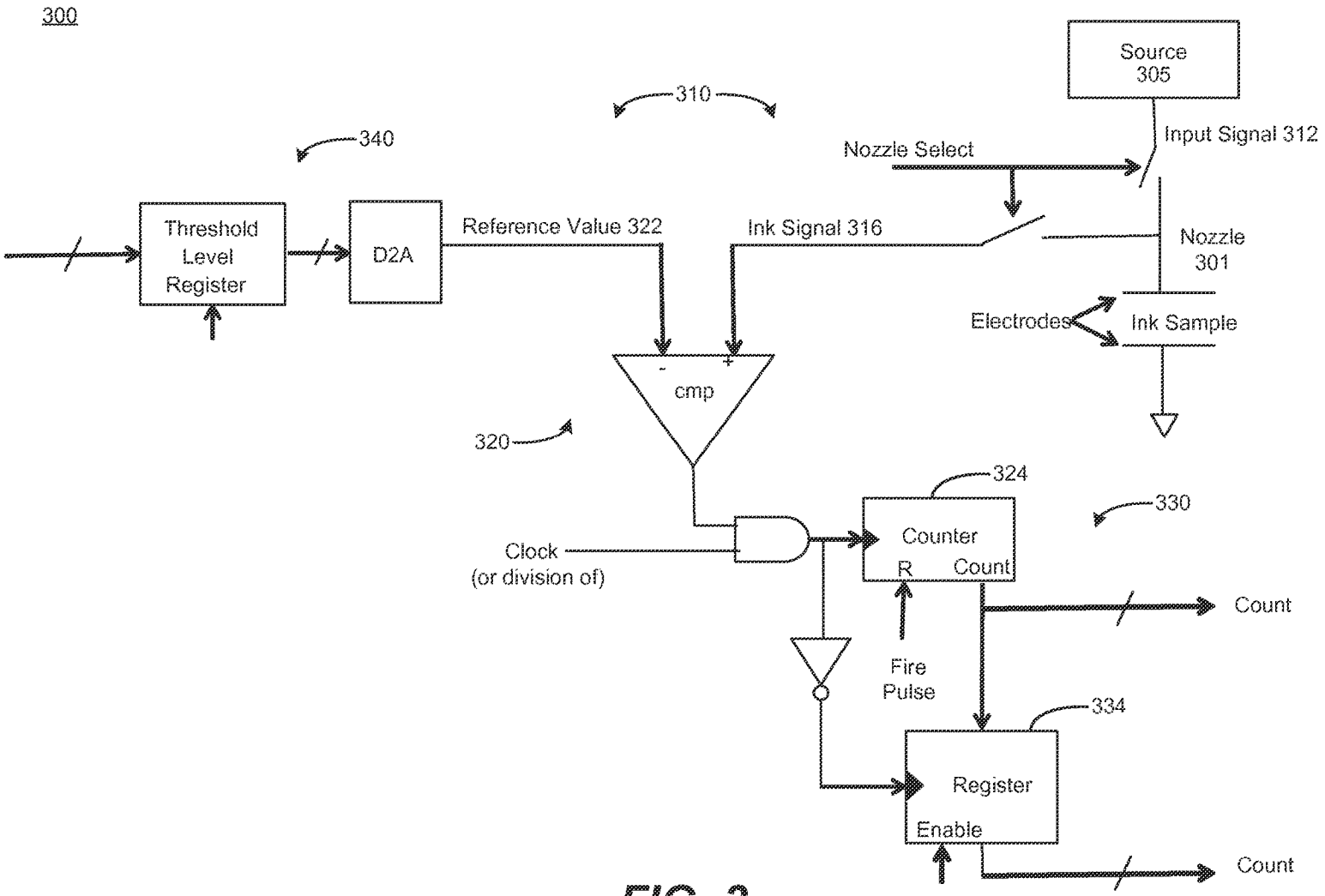
FIG. 3 is a block diagram of a device including a signal module according to an example.

FIG. 3 is a block diagram of a device 300 including a signal module 310 according to an example. The device also includes a comparison module 320, evaluation module 330, and storage module 340.

The signal module 310 is shown using example circuitry, and in alternate examples, different circuitry may be substituted (e.g., using different types of switches, gates, or other circuit elements). Switches are used to connect the source 305, such as a current source or voltage source, to deliver the input signal 312 to the nozzle 301. In an example, the switches may be provided as a pass field-effect transistor (FET), to connect the input signal 312 to the electrode of a given nozzle 301. A plurality of nozzles 301 may be selected and evaluated, e.g., in succession, based on the switches. The switches may be controlled by a nozzle select signal, generated by a controller (not shown), which may be external to the device 300, and/or on-die. In an example, the nozzle select signal may be generated by the signal module 310. A switch also is to selectively connect the electrode of the nozzle 301 to the comparison module 320, to pass the resulting ink signal 316 to the comparison module 320. As illustrated, the ink signal 316 is selectively connected, via a switch, to the positive ("+") port of an analog voltage comparator. Accordingly, the switching between the plurality of nozzles enables the comparison module 320, and following modules/circuits, to be selectively shared for all nozzles.

The comparison module 320 includes a comparator circuit element to compare the ink signal 316 to the reference value 322. The negative ("−") port of this comparator is connected to the reference value 322, which may be provided as a stable voltage corresponding to a "threshold." This threshold reference value 322 may be provided by a controller, such as a computer CPU or a printer. In an example, the printer controller may provide the reference value 322 once at printer startup, storing the reference value 322 to a "threshold" level register. In an alternate example, the threshold may be provided by an EPROM that is also contained on-die. The reference value 322 may be stored in a digital format by the register, and the digital value stored in the register may be converted to an analog "threshold" reference value voltage by way of a digital analog converter (DAC or D2A). The comparator and DAC may be "borrowed" or otherwise repurposed/shared for other purposes on the inkjet printhead. For example, the device 300 may borrow/repurpose a comparator and DAC from temperature control circuitry on the inkjet printhead die, when not being used for other nozzle health purposes that might interfere with its being borrowed/repurposed. The output of the comparator of the comparison module 320 is provided to the evaluation module 330.

The evaluation module 330 receives the output of the comparator, which will be in the form of a digital signal showing "high" when the ink signal 316 indicates that ink is out of the nozzle 301, and "low" when the ink signal 316 indicates that ink is in the nozzle 301 (e.g., based on the threshold comparison according to the reference value 322). Such results may be varied as described above, e.g., based on iteratively varying the input signal 312, and/or by iteratively varying the reference value 322. In such examples, the digital output of the comparator from the comparison module 320 may be used to build more information about the ink signal 316 over time, as described above with reference to earlier figures.

The evaluation module 330 may include a counter 324 to count clock cycles (or divisions thereof), e.g., between the time that the fire pulse falls, until the time that the ink signal 316 falls below the threshold reference value 322 (as determined by the comparator of the comparison module 320). The clock (or a division thereof) may be chosen of a high enough frequency to provide timing resolution sufficient to determine whether the measured ink refill timing is within acceptable ranges. The clock is selectively passed to the counter 324 via an AND gate that is to AND the clock with the output of the comparator.

The counter 324 is held off via its 'reset' function by the fire pulse signal being high. Once the fire pulse ends (fire pulse goes low), the reset is removed. By way of the AND gate, if the output of the comparator is high (ink is out of the nozzle), then the clock signal is transmitted to the clock port of the counter 324, and counting of the clock begins. Counting continues until the clock signal is blocked, via the AND gate, when the comparator goes low (e.g., the ink is back in the nozzle 301). Thus, the counter 324 is held off while fire=1. Counting is allowed to start if fire=0. Count stops when the ink signal 316 falls below the threshold established by the reference value 322.

The resulting count in the counter 324 represents the length of time from the fall of fire pulse until ink returns to the nozzle 301. This count may be utilized in the printhead, or may be communicated back to the printer/controller for further interpretation and usage (e.g., to evaluate nozzle health). An optional register 334 may be added to store the value of the counter 324 upon the falling edge of the last clock pulse to be counted (on the rising edge). A secondary latch control may be used to create a time window for when the count latching may be updated. This secondary register enables the counter 324 to be freed to evaluate a subsequent one of the plurality of nozzles 301, leaving the count value in the register 334 stable while being used on-die or communicated off-die. Thus, the register 334 may continue to follow the counter 324 until a falling edge of the final clock (rising) is counted. Output of the AND gate is logically flipped by a NOR gate, and used to control the register 334.

Thus, the various examples/modules discussed herein may be achieved using a minimal amount of circuitry to determine nozzle health. The circuitry is minimal enough to be contained on the very limited real-estate of a printhead die. Accordingly, the examples described herein enable the printhead die to have self-contained nozzle health evaluation. This can eliminate a need for communicating analog signals, such as the nozzle chamber indicator, off-die, resulting in avoiding extra connectivity expenses, and avoiding a need to expose the signals off-die, where the signals may be intercepted and spoofed by, e.g., ink counterfeiters. Further reduction in circuit elements is possible, e.g., by sharing other components available on the printhead die, such as registers, counters, gates, etc., and/or by using additional logic gates and pass transistors to multiplex the circuit elements for use in various modules.

Figure 4:
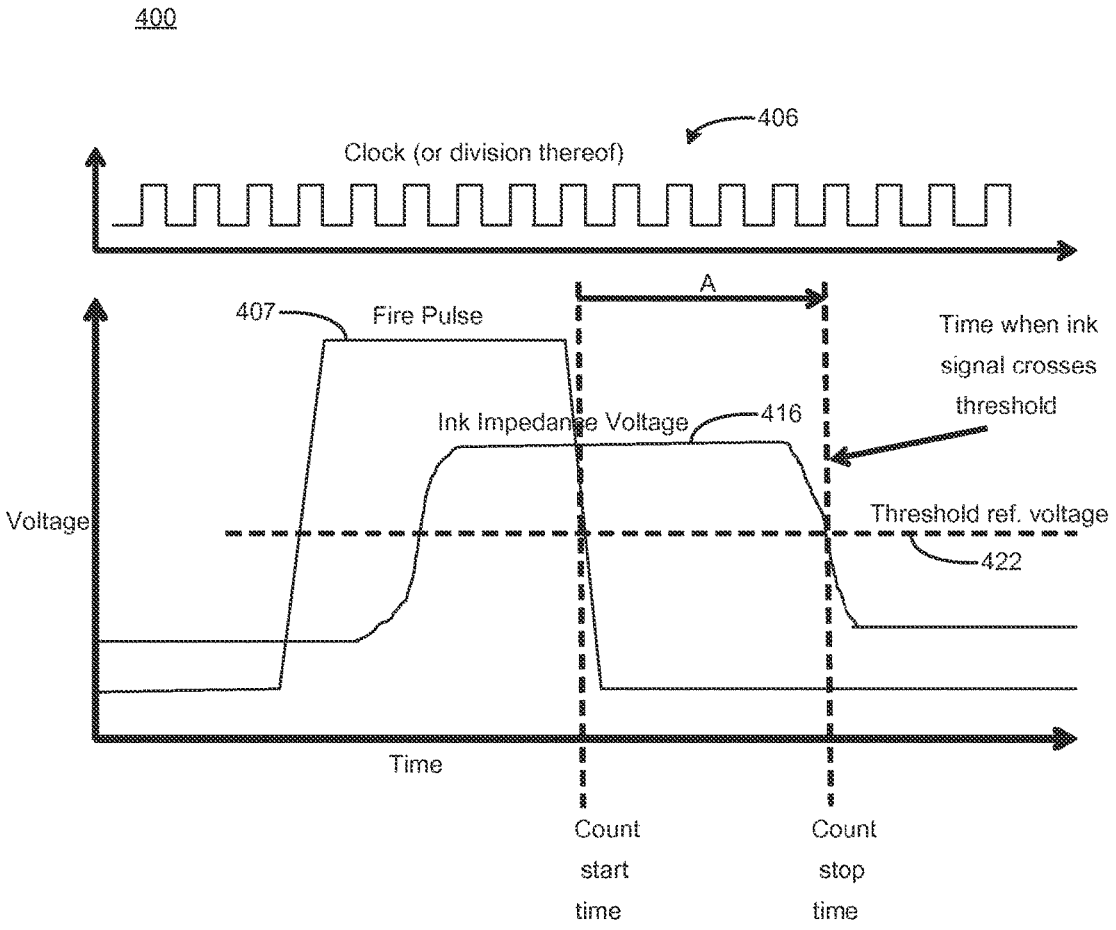
FIG. 4 is a chart showing an ink signal of a device according to an example.

FIG. 4 is a chart 400 showing an ink signal 416 of a device according to an example. Chart 400 also shows the fire pulse 407, the ink signal 416, and the reference value 422.

In this example, the x-axis schematically represents time, and the y-axis schematically represents voltage, which may correspond to a real portion of an ink signal impedance measurement (e.g., corresponding to a drive bubble's coverage of an electrode's surface area). Thus, for example, a minimum impedance voltage measurement may indicate that a large surface area of the sensor is in contact with ink. In contrast, a maximum impedance voltage measurement may indicate that a large surface area of the sensor is in contact with the drive bubble. Impedance measurements between the minimum and maximum may indicate that a portion of the sensor's surface area is covered with liquid ink and another portion is covered by the drive bubble.

The clock signal 406 is shown as a single representative waveform. However, various subdivisions of the clock signal 406 may be used (which would be represented with shorter or longer duration square waves). Thus, the waveforms may be measured according to a clock signal 406 of sufficient precision to enable accurate measurement. In an example, the clock signal 406 enables measurements within less than a microsecond margin of error. Accordingly, measurements may be taken accurately enough to identify impedance values within a narrow (e.g., high-resolution) time frame associated with distinguishing between healthy and unhealthy nozzle conditions.

The waveforms are not shown to scale in FIG. 4, and have been exaggerated or shifted for clarity. In an example, the fire pulse 407 may be associated with a width on the order of a microsecond, whereas the rising edge of the ink impedance signal 416 may lag behind the fire pulse 407 by on the order of 10-12 microseconds. However, the waveforms are shown overlapping in FIG. 4 to conserve space.

In operation, before the fire pulse 407 has been fired, the impedance of the ink signal 416 is low (e.g., shown below the threshold voltage of the reference value 422) because the ink sample is covering the nozzle chamber electrode. The signal module applies an input electrical signal into the ink sample via the electrode associated with a given nozzle to be evaluated. The nozzle is fired by the fire pulse 407, and after the fire pulse 407 begins, the drive bubble is formed. Formation of the drive bubble causes the voltage on the electrode to increase, in response to the increase in electrical impedance as the drive bubble displaces ink from the electrode. Thus, the ink signal 416 impedance rises, and after a time, the ink has been ejected from the nozzle chamber. The drive bubble collapses, the ink chamber refills with ink, and the impedance of the ink signal 416 returns to non-firing state. As the ink refills over the electrode (reducing the impedance), the voltage decreases as well. If these impedance changes happen within certain time limits, the device identifies, with some degree of certainty, that the nozzle is healthy. Thus, DBD is measuring the timing and magnitude of the impedance change to the sensor, to determine whether or not an ink drop successfully was ejected from the nozzle chamber.

A counter may be used to characterize the various waveforms. The counter may start incrementing at some point that is identifiable, and may end incrementing when the ink signal 416 crosses the threshold of reference value 422. Various different identifiable events may be used as the starting time for incrementing the counter. The ending time may be identified by the threshold being crossed, and also identified by whether the crossing is along a negative direction or a positive direction (e.g., whether the crossing is during drive bubble nucleation/formation, or during drive bubble collapse). In an example, the counter may be held in the reset mode until a predetermined time, and allowed to increment until the threshold reference voltage 422 is met. Thus, examples may count the duration (relative to fire pulse 407) to bubble formation, or as defined from fire pulse 407 to bubble collapse.

An example count duration of the clock signal 406 is represented by the arrow marked 'A' in FIG. 4. Arrow 'A' shows that the count start time is associated with a falling edge of the fire pulse 407, and the count stop time is associated with the ink signal 416 corresponding to the threshold of the reference value 422. Thus, 'A' may indicate a pulse width of the ink signal 416, and/or show a delay between the fire pulse 407 and the impedance voltage ink signal 416.

The duration of 'A' is shown measuring based on the falling edge of the fire pulse 407, and the falling edge of the impedance ink signal 416. In alternate examples, the measurement may be taken between a rising edge of the fire pulse 407 and a rising (e.g., leading) edge of the impedance ink signal 416, or the rising edge of the impedance ink signal 416 and the falling edge of the impedance ink signal 416 (e.g., directly measuring the width of the impedance voltage ink signal 416). The rising and falling edges of the impedance ink signal 416 indicate notable events that may correspond to ink nozzle health. For example, having no leading edge indicates that a drive bubble was never formed. The illustrated example timing qualities of the bubble formation and collapse indicated by the ink signal 416 are useful in determining whether the ink drop was successfully ejected, e.g., an indication of the health of the inkjet nozzle chamber.

For example, a blockage of the nozzle passage may prevent the formation of an ink droplet. The measurement results when a nozzle is blocked in this way may show that the drive bubble forms within a normal count/duration of that phase, but that the drive bubble collapses more slowly than expected resulting in an extended count/duration during that phase.

Iterative approaches (e.g., adjusting the threshold voltage reference value 422) enables the example minimal devices/circuitry to identify an appearance of the shape of the impedance voltage waveform, e.g., values for the ink signal 416 impedance voltage on the rising edge and/or the falling edge. Accordingly, examples provided herein may adjust the voltage threshold reference value 422, to not only identify how long it took to develop an impedance voltage of the ink signal 416, but also to what threshold value did the ink signal 416 achieve, and at what duration did the ink signal 416 achieve that identified threshold value.

In an example iterative approach, the threshold voltage of the reference value 422 may be set low initially, such that a time for the input signal 416 to achieve the low threshold would be relatively short. Then, a controller or other module may iterate by raising the threshold voltage reference value 422, resulting in a longer time needed to meet the raised threshold. This approach is iterated so that the minimal modules/circuitry can characterize the waveform of the formation of the drive bubble or other features, at a resolution associated with the increments of the threshold variation per iteration. In an example, the device may fire approximately 100 drops, and obtain approximately 50 measurements on the rising edge of the ink signal 416, and 50 measurements on the falling edge of the ink signal 416, for, e.g., 50 different threshold voltage reference values 422 on each side of the ink signal 416. Examples thus may test thousands of nozzles in a short period of time.

Figure 5:
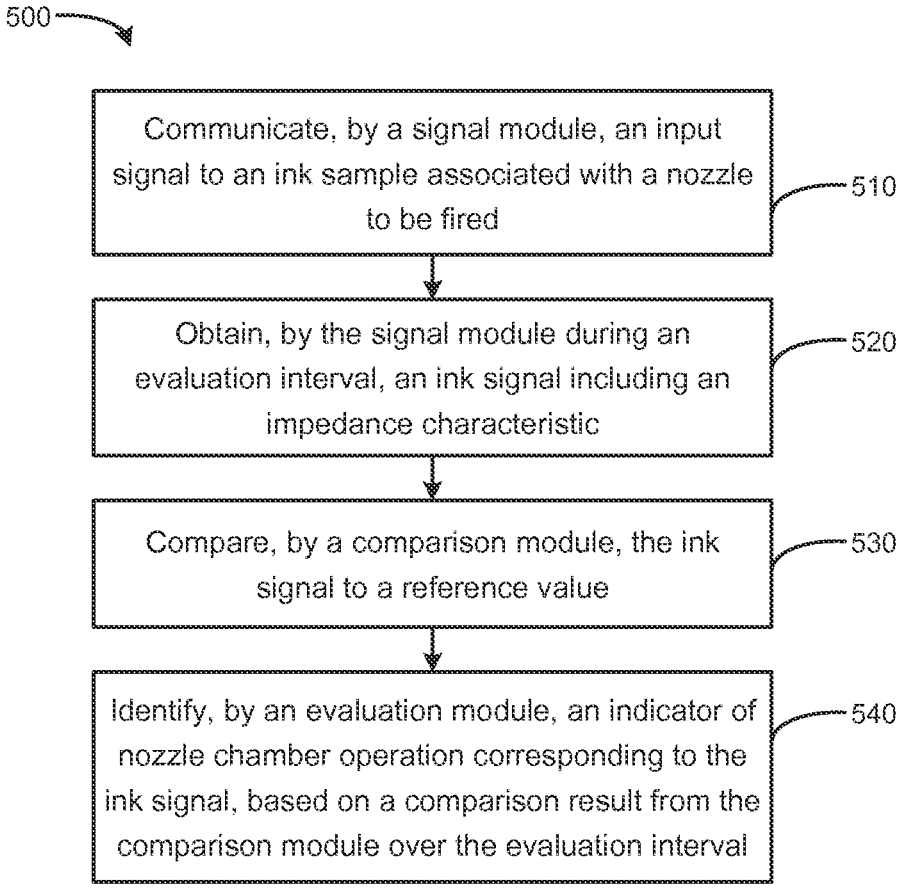
FIG. 5 is a flow chart based on identifying an indicator of nozzle chamber operation according to an example.

Referring to FIG. 5, a flow diagram is illustrated in accordance with various examples of the present disclosure. The flow diagram represents processes that may be utilized in conjunction with various systems and devices as discussed with reference to the preceding figures. While illustrated in a particular order, the disclosure is not intended to be so limited. Rather, it is expressly contemplated that various processes may occur in different orders and/or simultaneously with other processes than those illustrated.

FIG. 5 is a flow chart based on identifying an indicator of nozzle chamber operation according to an example. In block 510, a signal module is to communicate an input signal to an ink sample associated with a nozzle to be fired. For example, the signal module may select a given nozzle, and apply the input signal to the ink based on an electrode in fluid communication with the ink. In block 520, the signal module is to obtain, during an evaluation interval, an ink signal including an impedance characteristic. For example, a counter may be incremented to identify the interval, while the input signal causes the ink to react by producing the ink signal. In block 530, a comparison module is to compare the ink signal to a reference value. For example, the reference value may be set as a threshold for a comparator to compare against the ink signal. In block 540, an evaluation module is to identify an indicator of nozzle chamber operation corresponding to the ink signal, based on a comparison result from the comparison module over the evaluation interval. For example, the evaluation module may identify that the ink signal indicates healthy drive bubble formation and ink ejection, according to a duration that the ink signal spent above a threshold associated with the reference value.

The blocks of FIG. 5 may be performed to achieve at-speed DBD detection, e.g., based on an initial compare with the threshold reference value. If the initial compare indicates that a nozzle problem may be present, examples provided herein may then identify a need for closer examination. Thus, a printhead may dedicate additional time to perform a full characterization iterative sweep of the nozzle chamber response waveform, to identify a more detailed understanding of the nozzle issue (i.e., a 2-stage approach to nozzle health analysis). Thus, examples may quickly assess the print nozzles during a first stage, and upon identifying bad nozzles, may perform a more thorough (e.g., iterative) analysis and characterization of more specific nozzle condition(s).

What is claimed is:

1. A device comprising:

a signal source to communicate an input signal to an ink sample associated with a nozzle to be fired, to obtain, during an evaluation interval, an ink signal including an impedance characteristic;

a comparator to compare the ink signal to a reference value; and a counter to count over the evaluation interval in response to the comparing indicating that an evaluation criterion is satisfied, and the counter to stop counting in response to the comparing indicating that the evaluation criterion is not satisfied, a count value of the counter providing an indicator of nozzle chamber operation corresponding to the ink signal;

wherein the signal source is contained on an inkjet printhead die, such that the device may generate the input signal on the inkjet printhead die.

2. The device of claim 1, wherein the comparator and the counter are also contained on the inkjet printhead die, such that the device may evaluate the indicator without the ink signal leaving the inkjet printhead die.

3. The device of claim 1, further comprising switches to selectively couple the signal source to the ink sample, and couple the ink signal to the comparator.

4. The device of claim 1, further comprising:

a storage to store the reference value; and a controller to iteratively update the reference value in successive iterations, wherein the comparator is to compare ink signals in the successive iterations to respective updated reference values.

5. The device of claim 4, wherein the storage includes a programmable memory on the inkjet printhead die.

6. The device of claim 1, wherein the counter is to start counting in response to a fire pulse.

7. The device of claim 6, wherein once the counter starts counting in response to the fire pulse, the counter is to continue to count in response to the comparing indicating that an evaluation criterion is satisfied.

8. The device of claim 6, wherein the fire pulse is to activate the nozzle.

9. The device of claim 1, wherein the count value of the counter identifies a duration between activation of the nozzle and a time at which the comparing indicates that the evaluation criterion is not satisfied.

10. The device of claim 9, further comprising a register to store the count value of the counter.

11. The device of claim 1, wherein the evaluation criterion is satisfied if the ink signal is greater than the reference value, and the evaluation criterion is not satisfied if the ink signal is below the reference value.

12. The device of claim 1, wherein the counter is to count clock cycles of a clock signal while the comparing indicates that the evaluation criterion is satisfied.

13. The device of claim 12, further comprising a gate to:

enable the clock signal to be transmitted to a clock port of the counter while the comparing indicates that the evaluation criterion is satisfied, block the clock signal from the clock port of the counter if the comparing indicates that the evaluation criterion is not satisfied.

14. A device comprising:

a signal module comprising a signal source, a first switch, and a second switch, the first switch when activated to communicate an input signal to an ink sample associated with a nozzle to be fired, to obtain, during an evaluation interval, an ink signal including an impedance characteristic;

a comparator, wherein the second switch when activated is to couple the ink signal to an input of the comparator, the comparator to compare the ink signal to a reference value; and a counter to count over the evaluation interval in response to the comparing indicating that an evaluation criterion is satisfied, and the counter to stop counting in response to the comparing indicating that the evaluation criterion is not satisfied, a count value of the counter identifies a duration of the evaluation interval and provides an indicator of nozzle chamber operation corresponding to the ink signal;

wherein the signal module is contained on an inkjet printhead die, such that the device may generate the input signal on the inkjet printhead die.

15. The device of claim 14, further comprising a register to store the count value of the counter independent of whether the counter is reset.

16. The device of claim 14, wherein the counter is to start counting in response to a fire pulse that activates the nozzle, the counter to continue to count in response to the comparing indicating that an evaluation criterion is satisfied.

17. The device of claim 14, wherein the counter is to count clock cycles of a clock signal while the comparing indicates that the evaluation criterion is satisfied, the device further comprising a gate to:

enable the clock signal to be transmitted to a clock port of the counter while the comparing indicates that the evaluation criterion is satisfied, block the clock signal from the clock port of the counter if the comparing indicates that the evaluation criterion is not satisfied.

18. A method comprising:

communicating an input signal from a signal source to an ink sample associated with a nozzle to be fired;

receiving, during an evaluation interval, an ink signal including an impedance characteristic, the ink signal responsive to the input signal communicated to the ink sample;

comparing, by a comparator, the ink signal to a reference value;

counting, by a counter over the evaluation interval, while the comparing indicates that an evaluation criterion is satisfied;

stopping the counter in response to the comparing indicating that the evaluation criterion is not satisfied; and outputting a count value of the counter, the count value providing an indicator of nozzle chamber operation corresponding to the ink signal.

19. The method of claim 18, further comprising initializing the reference value by a printer, in response to printer startup.

20. The method of claim 18, further comprising:

enabling, by a gate, transmission of the clock signal to a clock port of the counter while the comparing indicates that the evaluation criterion is satisfied, blocking, by the gate, the clock signal from the clock port of the counter if the comparing indicates that the evaluation criterion is not satisfied.

* * * * *